United States Patent [19]

Forbes

[11] 4,016,667

[45] Apr. 12, 1977

[54] SIDE SPRING DOOR ACTION

[76] Inventor: John P. Forbes, Box 355, Newport, N.H. 03773

[22] Filed: Mar. 31, 1976

[21] Appl. No.: 672,411

[52] U.S. Cl. ..... 42/6; 42/18

[51] Int. Cl.[2] ..... F41C 25/00

[58] Field of Search ..... 42/6, 26, 30, 31, 17, 42/18, 49, 50

[56] References Cited

UNITED STATES PATENTS

| | | | |
|---|---|---|---|
| 290,905 | 12/1883 | McLean | 42/30 |
| 492,212 | 2/1893 | Krag et al. | 42/18 |
| 2,655,753 | 10/1953 | Salas | 42/6 |
| 3,803,739 | 4/1974 | Haines et al. | 42/6 |

*Primary Examiner*—Charles T. Jordan

[57] ABSTRACT

An action for a firearm, such as a rifle or shotgun, the action being mounted upon a door which swings sidewardly out of a side of the firearm, the action including a stationary frame supported on the inner side of the door, the frame containing a pair of compression coil springs, which bear against the underside of a plate upon which the cartridges are loaded.

2 Claims, 3 Drawing Figures

SIDE SPRING DOOR ACTION

This invention relates generally to firearms, such as have a magazine within which several cartridges may be held at a same time for purpose of rapid firing one after another. A principal object of the present invention is to provide a firearm in which bullet or shotgun shells can be loaded into the magazine from a side, by means of a sidewardly pivotable door.

Another object is to provide a side spring door action, which is easier to load, more convenient and quick to operate.

Other objects are to provide a side spring door action, which is simple in design, inexpensive to manufacture, rugged in construction, easy to use and efficient in operation.

These and other objects will be readily evident upon a study of the following specification and accompanying drawing, wherein.

Figure 1:
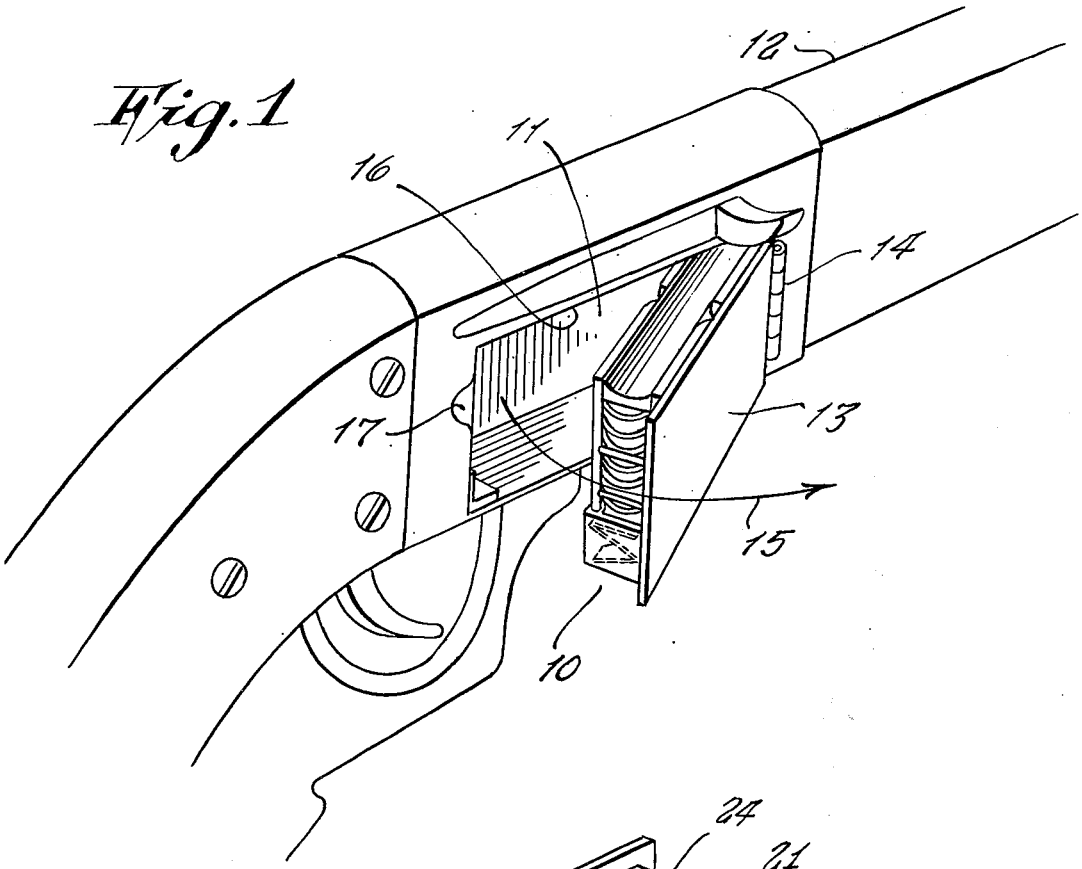
FIG. 1 is a perspective view of a firearm shown with a side spring door in a partly opened position.
Figure 2:
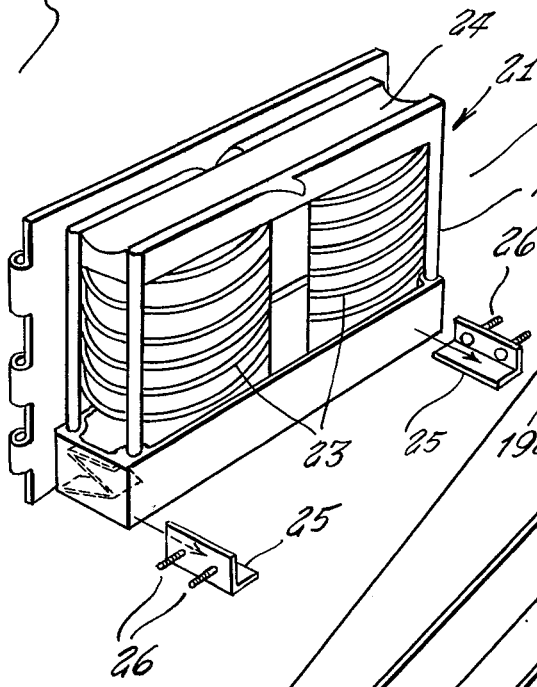
FIG. 2 is a rear perspective view of the door, and showing the action mounted thereupon.
Figure 3:
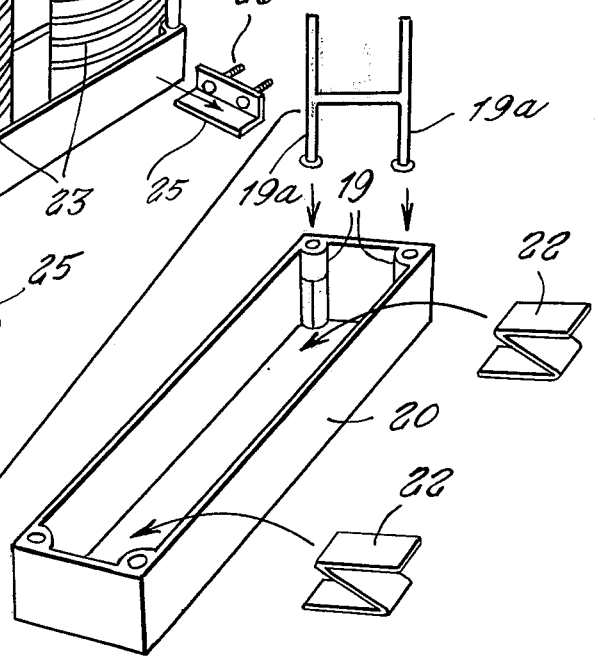
FIG. 3 is a detail of certain components of the structure illustrated in FIG. 2.

Referring now to the drawing in greater detail, the reference numeral 10 represents a side spring door action, according to the present invention, wherein there is a means for moving the same inwardly and outwardly of a magazine 11 of a firearm 12. The magazine has an opening from a side, which is closable by means of a door 13 pivotable about a hinge 14, so that the door can swing sidewardly as indicated by arrow 15. Two catches, not shown, are provided for retaining the door in a closed position. Adjacent an edge of the door opening 16 there is a thumb hold 17, as shown in FIG. 1.

The action includes a frame 18, supported upon the inner side of the door 13, and which includes posts 19*a* received within sleeves 19 formed in the corners of a receptacle 20, which together with the posts forms components of a clip 21. Inside the receptacle, and near each opposite end thereof, there are a pair of leaf springs 22, and the clip additionally includes a pair of compression coil springs 23, which bear against the underside of a plate 24, upon which the bullets or shells are loaded, one above the other, so as to depress the plate 24 downwardly against the compression coil springs 23. As shown, the upper side of the plate 24 is downwardly concaved, so as to conform to the shape of the side of the bullet or shell.

Within each end of the magazine 11, there is mounted an angle shaped track 25, secured by means of screws 26, the tracks serving as rails, upon which the action slides, when the door is pivoted into a closed position.

In operative use, it is now evident that in order to load the magazine, the catches are released, so that the door 13 may be swung outwardly, so as to load the clip of the action.

Thus there is provided a novel means for loading a firearm.

While various changes may be made in the detail construction, it is understood that such changes will be within the spirit and scope of the present invention as is defined by the appended claims.

What I now claim is:

1. A side spring door action for a firearm, comprising in combination, a magazine behind a barrel of a firearm, a sideward opening to said magazine, said opening being closeable by means of a sidewardly pivotable door about a hinge, an inner side of said door carrying an action, said action including a clip supported within a frame secured to a rear side of said door, said clip including a pair of compression coil springs bearing against an underside of a plate upon which projectiles of a firearm are loaded by moving said plate against said compression coil springs.

2. The combination as set forth in claim 1, wherein said magazine opening includes a track at each end comprising an angle rail upon which said action is slideable into said magazine.

* * * * *